US007255509B2

(12) United States Patent
Wang

(10) Patent No.: US 7,255,509 B2
(45) Date of Patent: Aug. 14, 2007

(54) PAINT ROLLER ASSEMBLY

(75) Inventor: Miguel Wang, No. 18, Cheng-Hsing Lane, Fan-Hua Rd., Hsiu-Shui Hsiang, Chang-Hua Hsien (TW)

(73) Assignee: Miguel Wang, Chang-Hua Hsien (TW)

( * ) Notice: Subject to any disclaimer, the term of this patent is extended or adjusted under 35 U.S.C. 154(b) by 0 days.

(21) Appl. No.: 11/376,400

(22) Filed: Mar. 15, 2006

(65) Prior Publication Data

US 2007/0022554 A1 Feb. 1, 2007

(30) Foreign Application Priority Data

Jul. 28, 2005 (TW) ..... 94125553 A
Sep. 29, 2005 (TW) ..... 94134095 A

(51) Int. Cl.

| | |
|---|---|
| ***B05C 1/00*** | (2006.01) |
| ***B05C 17/025*** | (2006.01) |
| ***B05C 17/03*** | (2006.01) |
| ***B05C 17/035*** | (2006.01) |
| ***B43K 8/20*** | (2006.01) |

(52) U.S. Cl. ..... 401/197; 401/208; 401/218; 15/230.11

(58) Field of Classification Search ..... 401/196, 401/197, 203, 207, 208, 218–220; 15/105, 15/248.2, 230.11; 118/258, 264; 492/16, 492/17

See application file for complete search history.

(56) References Cited

U.S. PATENT DOCUMENTS

| | | | | |
|---|---|---|---|---|
| 4,639,156 A * | 1/1987 | Stern et al. | ..... | 401/197 |
| 4,692,048 A * | 9/1987 | Krohn et al. | ..... | 401/197 |
| 6,059,476 A * | 5/2000 | Brugger | ..... | 401/197 |
| 6,206,599 B1 * | 3/2001 | Buchanan et al. | ..... | 401/197 |

* cited by examiner

*Primary Examiner*—Tuan Nguyen
(74) *Attorney, Agent, or Firm*—Timothy J. Keefer; Seyfarth Shaw LLP

(57) ABSTRACT

A paint roller assembly includes a roller support having head and neck portions and a support tube defining an axis, a coupling unit, and a roller unit. The support tube has a free end, and a plurality of spaced-apart apertures in fluid communication with an axial hole in the roller support. The neck portion has a retaining part. An end cap is sleeved on the free end of the support tube. The roller unit includes a tubular sleeve that has first and second end portions coupled rotatably and respectively to the retaining part and the end cap, and a sponge body fixed around the tubular sleeve. The coupling unit is disposed between the retaining part and the first end portion of the tubular sleeve. A handle is connected to the head portion of the roller support.

10 Claims, 8 Drawing Sheets

PAINT ROLLER ASSEMBLY

CROSS-REFERENCE TO RELATED APPLICATION

This application claims priority of Taiwanese Application No. 094125553, filed on Jul. 28, 2005, and Application No. 094134095, filed on Sep. 29, 2005.

BACKGROUND OF THE INVENTION

1. Field of the Invention

The invention relates to a paint roller assembly.

2. Description of the Related Art

Referring to FIGS. 1 and 2, a conventional paint roller assembly, as disclosed in Taiwanese Patent No. 113656, includes a feeding tube 1, an inner tube 2 sleeved on the feeding tube 1, an end cover unit 3 coupled to the feeding tube 1 and the inner tube 2, and a roller unit 4 supported on the feeding tube 1 by the inner tube 2 and the end cover unit 3. The feeding tube 1 has a plurality of through holes 101. The inner tube 2 has a first end cap 201, and a tubular portion 202 extending outwardly from one side of the first end cap 201. An outer diameter of the first end cap 201 is larger than that of the tubular portion 202. The tubular portion 202 has four outward grooves 203 that extend axially along the length of the tubular portion 202 and that are spaced apart from each other at an angular distance of 90°, and a plurality of slots 204 formed in walls that define the grooves 203.

The end cover unit 3 includes a second end cap 301, a tubular ring 302 engaged to the second end cap 301, a stop ring 303 inserted into the tubular ring 302, a seal ring 304 disposed between the stop ring 303 and the tubular ring 302, and a limiting ring 305 inserted into the second end cap 301 from an outer side thereof. The tubular ring 302 has four angularly spaced-apart protrusions 302' (only two are visible) projecting outwardly from an outer periphery thereof and engageable with the respective outward grooves 203. The second end cap 301 and the tubular ring 302 are further engaged to each other through a rib 301' and a groove 302" formed on their corresponding inner surfaces.

The roller unit 4 includes an annular tube 401, and an applicator body 402 fixed to the annular tube 401. The annular tube 401 has a peripheral wall formed with a plurality of spaced-apart through holes 403, and is supported by the first and second end caps 201, 301 on the feeding tube 1.

Paint is supplied to the applicator body 402 of the roller unit 4 from the feeding tube 1 by passing through the through holes 101, the slots 204, and the through holes 403. Leakage of the paint is prevented by the provision of the seal ring 4.

Although the conventional paint roller assembly can achieve its intended purpose, the construction of the end cover unit 3 is very complicated. Furthermore, replacement of a new roller unit 4 is difficult due to the complicated structure of the end cover unit 3.

SUMMARY OF THE INVENTION

Therefore, the object of the present invention is to provide a paint roller assembly that has simple components, that is easy to assemble and disassemble, that has a roller unit which can be easily replaced, and that can provide a good anti-leak effect.

According to this invention, a paint roller assembly comprises a roller support, an end cap, a coupling unit, a roller unit, and a handle. The roller support includes a head portion, a neck portion reduced in cross section from the head portion, and a support tube reduced in cross section from the neckportion and defining an axis. The roller support defines an axial hole extending through the support tube and the neck portion and into the head portion along the axis. The support tube has a peripheral wall, a plurality of spaced-apart apertures formed in the peripheral wall and in fluid communication with the axial hole, and a free end distal to the neck portion. The neck portion has a retaining part. The end cap is sleeved on the free end of the support tube. The roller unit includes a tubular sleeve, and a sponge body fixed around the tubular sleeve. The tubular sleeve has a first end portion coupled rotatably to the retaining part of the neck portion through the coupling unit, and a second end portion opposite to the first end portion and coupled to the end cap so as to be rotatable relative to the support tube. The handle is connected to the head portion of the roller support. The coupling unit is disposed between the retaining part and the first end portion of the tubular sleeve, and includes a tongue provided on one of the retaining part and the first end portion of the tubular sleeve, and a retaining groove formed in the other of the retaining part and the first end portion of the tubular sleeve.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
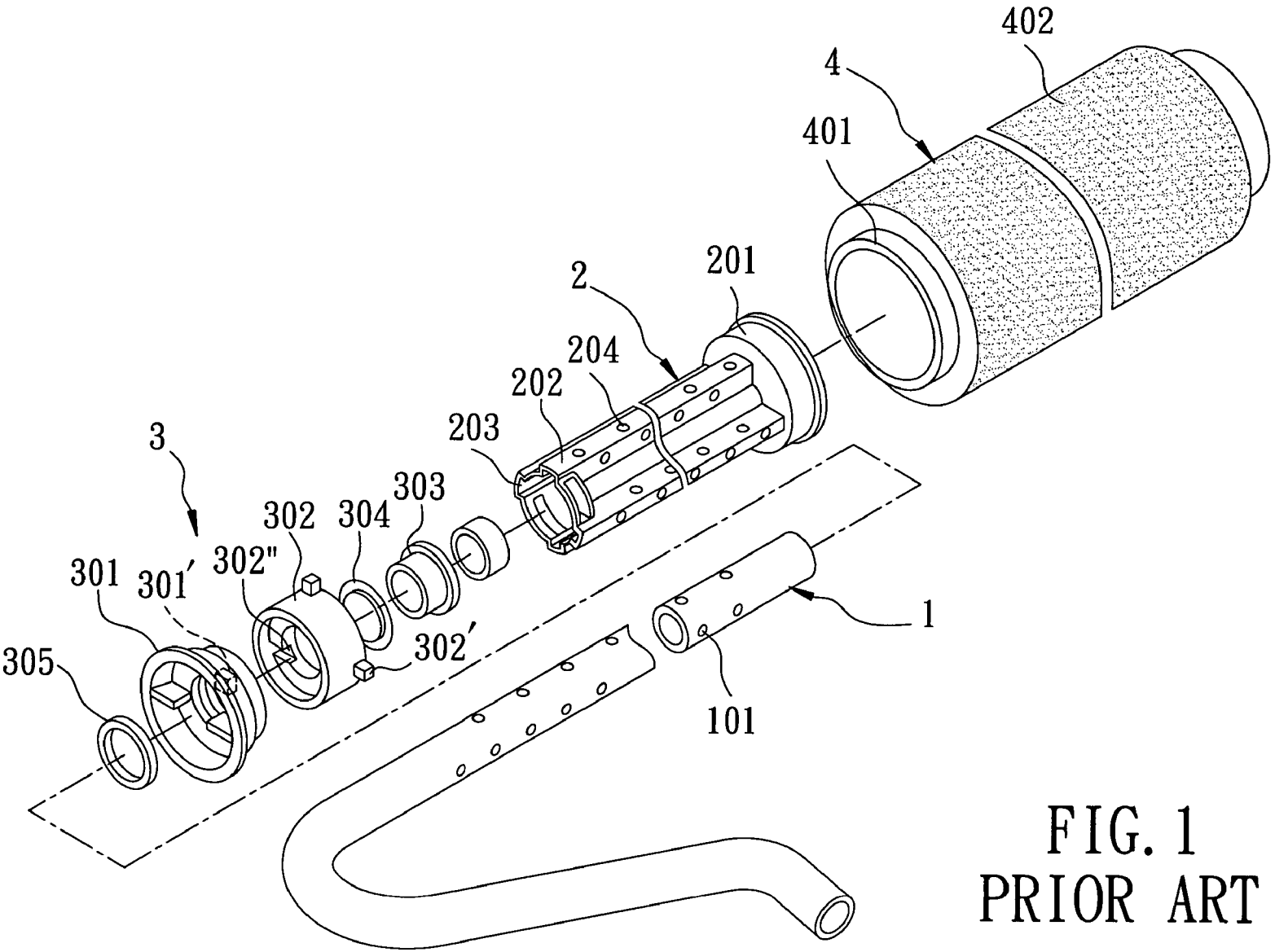
FIG. 1 PRIOR ART
FIG. 1 is an exploded perspective view of a conventional paint roller assembly disclosed in Taiwanese Patent No. 113656.
Figure 2:
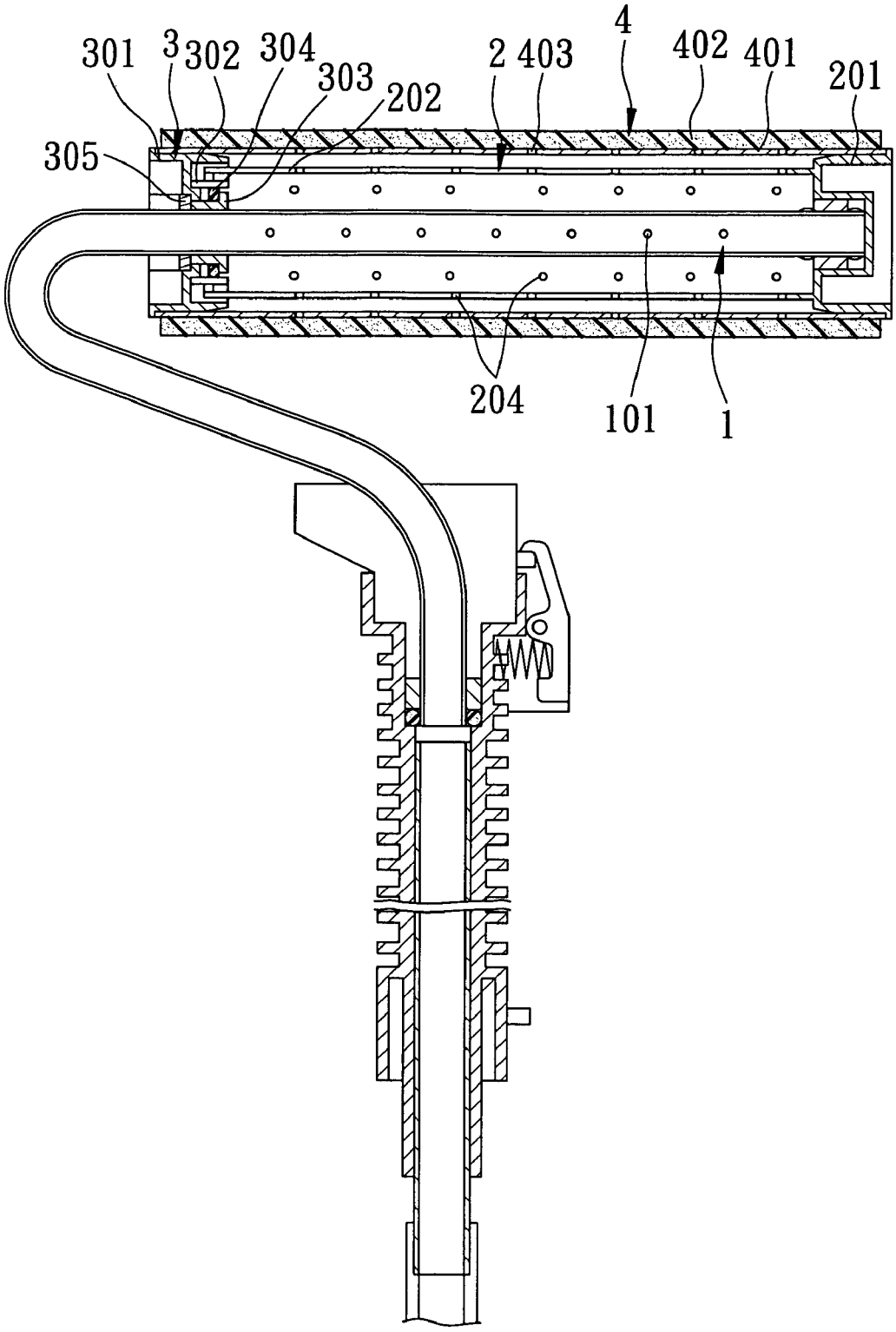
FIG. 2 PRIOR ART
FIG. 2 is a sectional view of the conventional paint roller assembly in an assembled state.

Before the present invention is described in greater detail, it should be noted that like elements are denoted by the same reference numerals throughout the disclosure.

Figure 3:
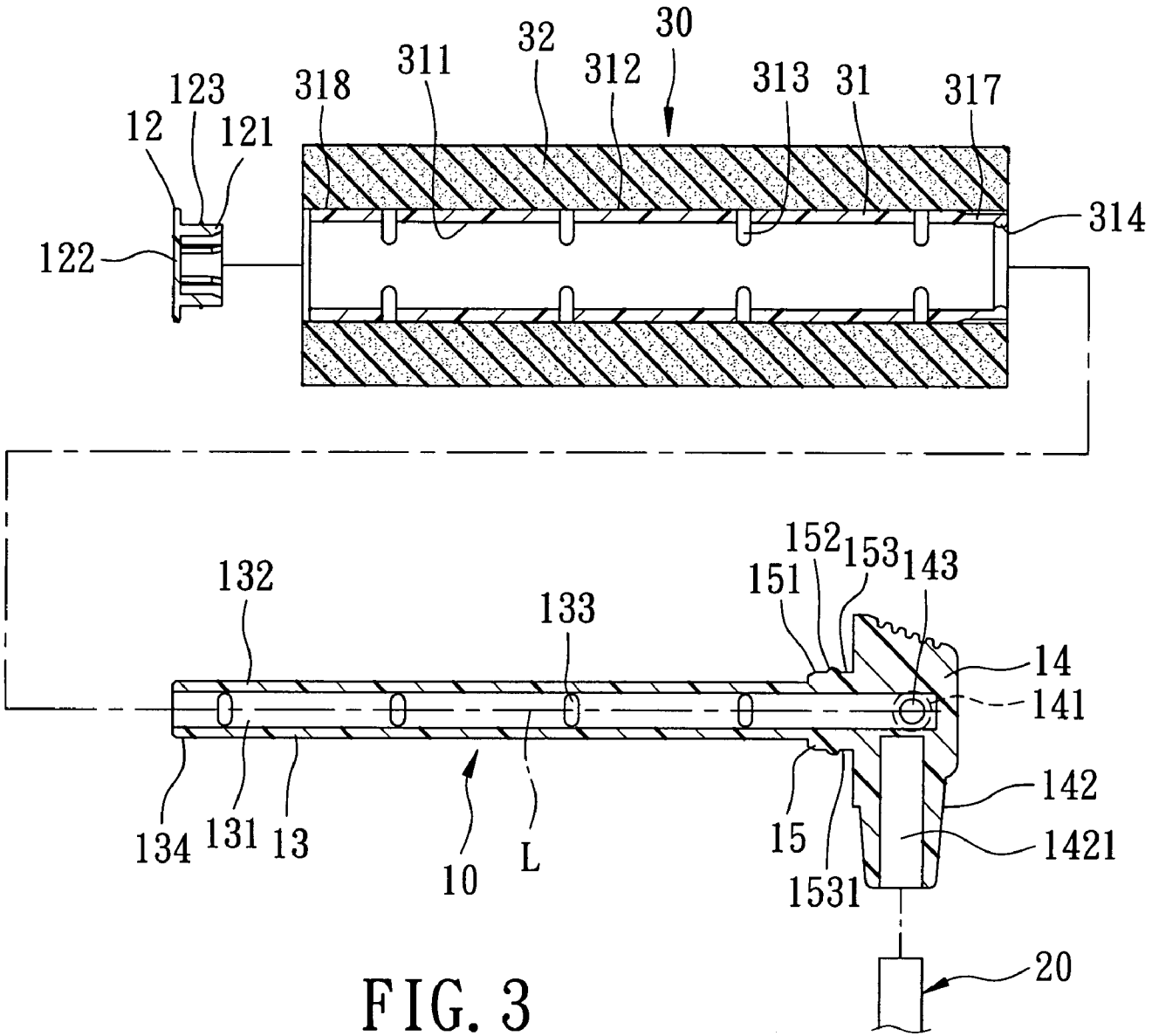
FIG. 3 is a fragmentary exploded sectional view of the first preferred embodiment of a paint roller assembly according to the present invention.
Figure 4:
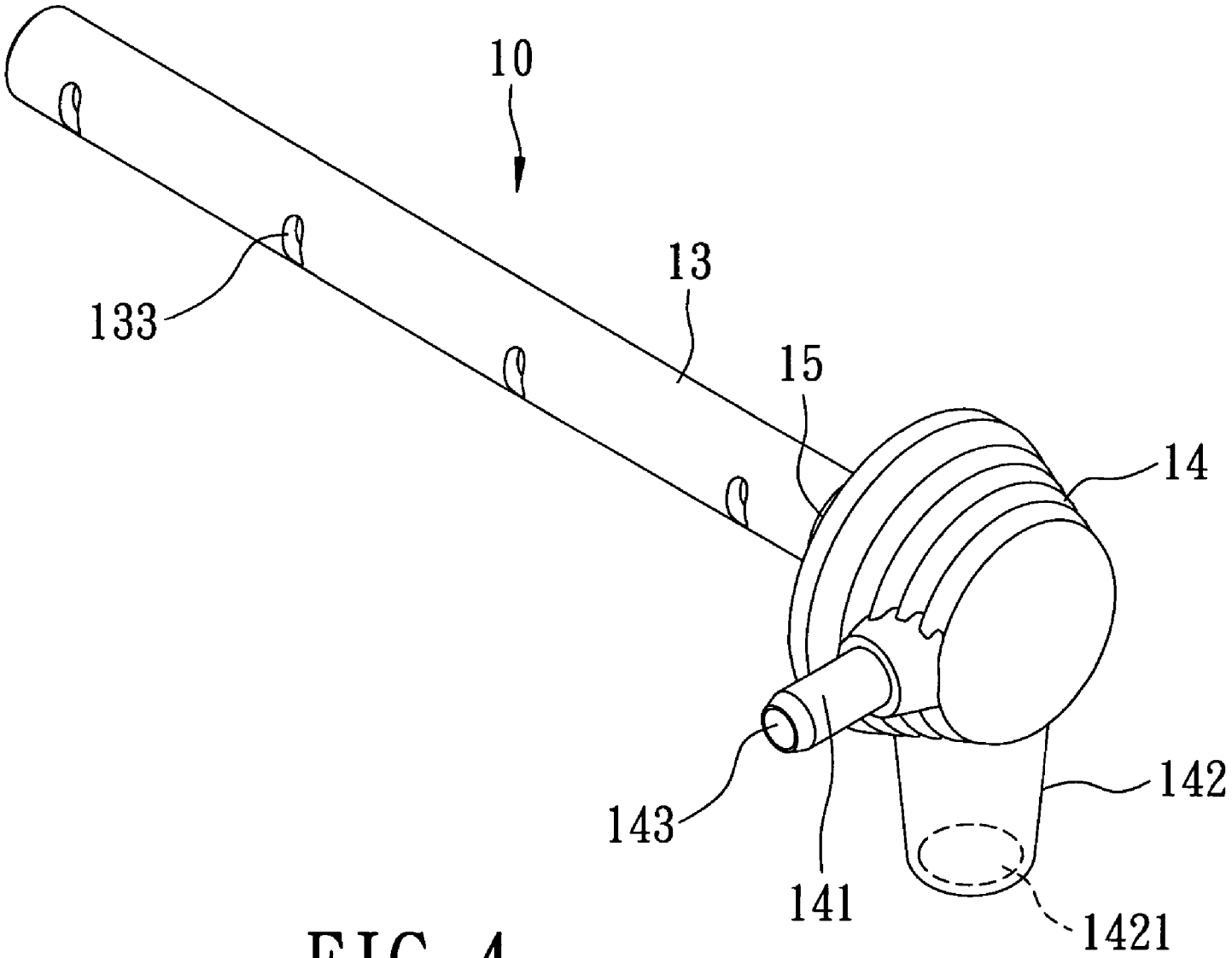
FIG. 4 is a perspective view of a roller support of the first preferred embodiment.
Figure 5:
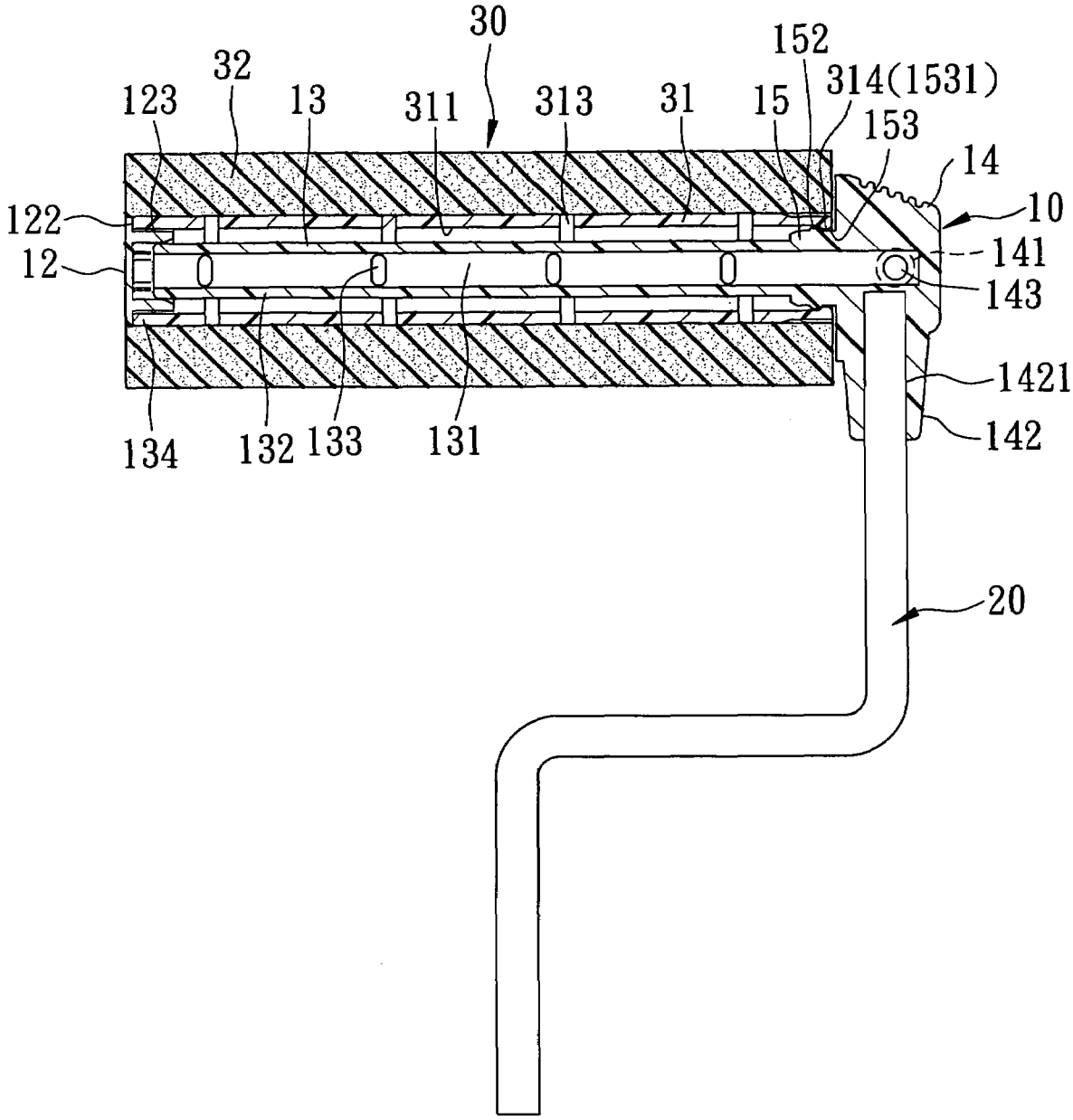
FIG. 5 is a sectional view of the first preferred embodiment in an assembled state.

Referring to FIGS. 3 to 5, the first preferred embodiment of a paint roller assembly according to the present invention is shown to comprise a roller support 10, a handle 20, a coupling unit, a roller unit 30, and an end cap 12.

The roller support 10 includes a head portion 14, a neck portion 15 reduced in cross section from the head portion 14, and an elongated support tube 13 reduced in cross section from the neck portion 15 and defining an axis (L). In this embodiment, the head portion 14, the neck portion 15, and the support tube 13 are formed integrally as one piece. The roller support 10 defines an axial hole 131 that extends through the support tube 13 and the neck portion 15 and into the head portion 14.

The head portion 14 includes a tubular connecting part 141 extending outwardly from the head portion 14 along a direction transverse to the axis (L), and a handle-connecting part 142 extending outwardly from the head portion 14 along a direction transverse to the axis (L) and the tubular connecting part 141 and having a slot 1421. The tubular connecting part 141 has a through hole 143 in fluid communication with the axial hole 131, and is adapted to be connected to a paint supply device (not shown).

The neck portion 15 has a retaining part 153, and an annular protrusion 152 protruding radially and outwardly from an outer periphery 151 of the retaining part 153.

The support tube 13 has a peripheral wall 132, and a plurality of spaced-apart apertures 133 formed in the peripheral wall 132 and in fluid communication with the axial hole 131. The support tube 13 further has a free end 134 distal to the neck portion 15.

The handle 20 is connected to the head portion 14 of the roller support 10. That is, the handle 20 is inserted into the slot 1421 in the handle-connecting part 142 of the head portion 14.

The roller unit 30 is mounted rotatably on the roller support 10, and includes a tubular sleeve 31, and a sponge body 32 fixed around the tubular sleeve 31. The tubular sleeve 31 has an inner peripheral face 311, an outer peripheral face 312 opposite to the inner peripheral face 311, and a plurality of spaced-apart groove holes 313 extending through the inner and outer peripheral faces 311, 312. The tubular sleeve 31 further has a first end portion 317, and a second end portion 318 opposite to the first end portion 317. The sponge body 32 is fixed to the outer peripheral face 312 of the tubular sleeve 31.

The coupling unit is disposed between the retaining part 153 of the neck portion 15 and the first end portion 317 of the tubular sleeve 31, and includes a tongue 314 and a retaining groove 1531. The tongue 314 is formed on the first end portion 317 of the tubular sleeve 31, and is configured as an annular protrusion projecting from the first end portion 317 of the tubular sleeve 31 into the retaining groove 1531. The retaining groove 1531 is formed in the retaining part 153 of the neck portion 15. The annular protrusion 152 of the neck portion 15 cooperates with the retaining part 153 and the head portion 14 to define the retaining groove 1531 of the coupling unit thereamong.

The end cap 12 includes a flanged portion 122, a sleeve portion 121 extending axially from the flanged portion 122, and an annular rib 123 projecting radially and outwardly from the sleeve portion 121.

The first end portion 317 of the tubular sleeve 31 is coupled rotatably to the retaining part 153 of the neck portion 15 through the coupling unit, and the second end portion 318 of the tubular sleeve 31 is coupled rotatably to the end cap 12 (to be described below). As such, the tubular sleeve 31 is rotatable relative to the support tube 13.

With reference to FIG. 5, the tubular sleeve 31 with the sponge body 32 fixed therearound is first sleeved on the support tube 13, and the handle 20 is inserted into the handle-connecting part 142 via the slot 1421. The tongue 314 engages the retaining groove 1531 in the retaining part 153 of the neck portion 15 after passing over the annular protrusion 152 of the neck portion 15, and is retained therein in such a manner that the tubular sleeve 31 can rotate around the axis (L). The sleeve portion 121 of the end cap 12 is then sleeved on the free end 134 of the support tube 13 with the flanged portion 122 abutting against the second end portion 318 of the tubular sleeve 31 so as to prevent the tubular sleeve 31 from being removed from the support tube 13. The annular rib 123 of the end cap 12 is in rotational contact with the inner peripheral face 311 of the tubular sleeve 31 at this time, and the tongue 314 is engaged with the retaining groove 1531 of the coupling unit. As a result of these two cooperative engagements, anti-leak effect of the present invention is achieved. Through the annular protrusion 152 of the neck portion 15 and the annular rib 123 of the end cap 12, which form contact points with the inner peripheral face 311 of the tubular sleeve 31, a frictional force during rotation of the tubular sleeve 31 relative to the support tube 13 is minimized, thereby ensuring a smooth rotation of the roller unit 30.

Paint is introduced into the axial hole 131 of the support tube 13 via the through hole 143 in the tubular connecting part 141. The paint flows from the axial hole 131 to the sponge body 32 through the apertures 133 in the support tube 13 and the groove holes 313 in the tubular sleeve 31, after which painting of a desired wall surface can be started.

To replace the roller unit 30, the user first removes the end cap 12 from the free end 134 of the support tube 13, after which the user exerts a slight pulling force on the sponge body 32 and hence on the tubular sleeve 31 so as to disengage the tongue 314 from the retaining groove 1531 by passing the tongue 314 over the annular protrusion 152. The tubular sleeve 31 is then pulled off of the support tube 13 along the axis (L). Hence, the roller unit 30 is removed easily from the roller support 10. A new roller unit 30 may be mounted on the roller support 10 by following the aforementioned steps in reverse.

Figure 6:
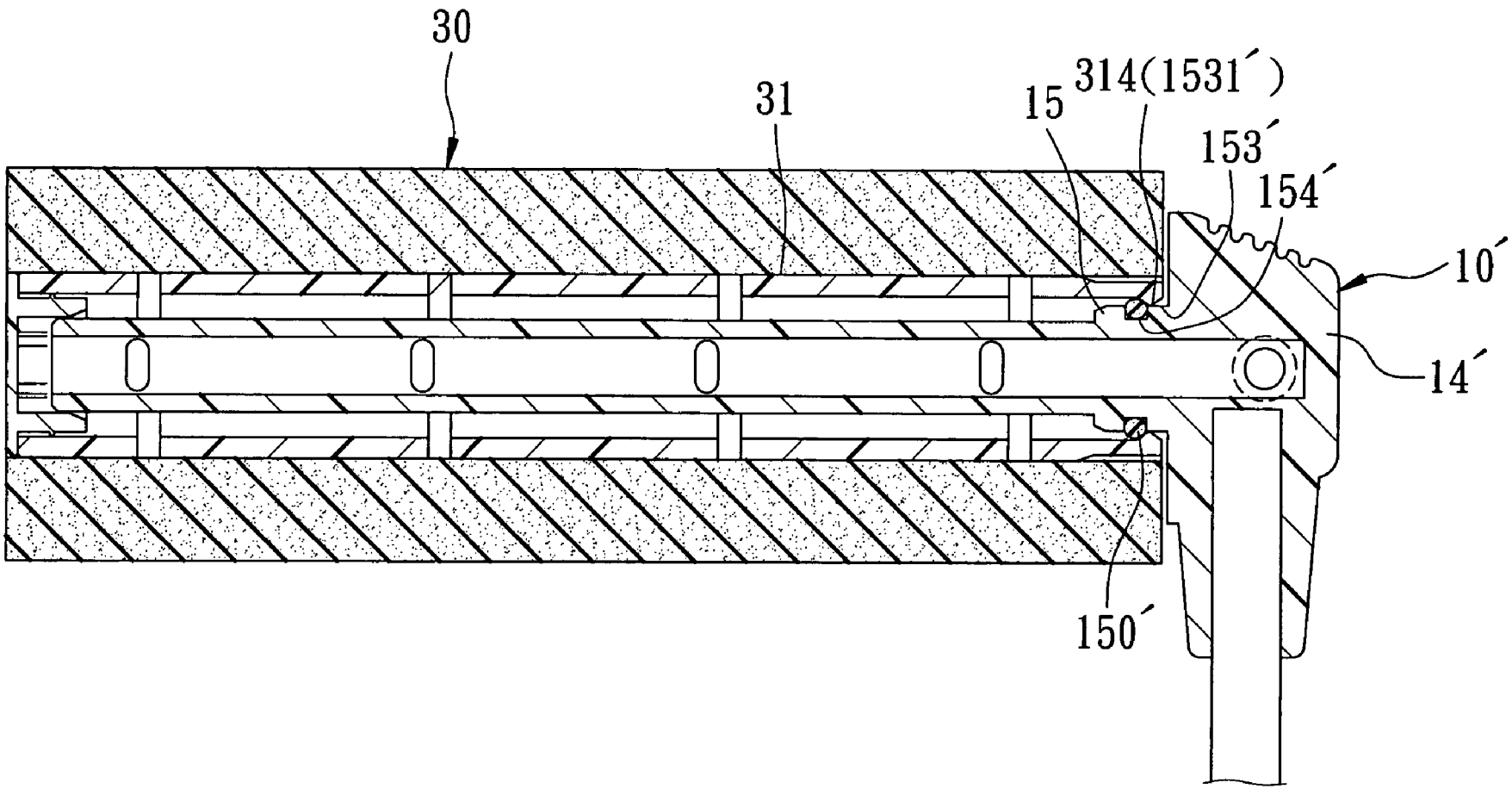
FIG. 6 is a fragmentary assembled sectional view of the second preferred embodiment of a paint roller assembly according to the present invention.

Referring to FIG. 6, the second preferred embodiment of a paint roller assembly according to the present invention is shown to be similar to the first preferred embodiment. However, in this embodiment, the coupling unit further has an annular recess 154' formed in the retaining part 153' of the neck portion 15', and an annular ring 150' disposed in and protruding outwardly from the annular recess 154' and in rotational contact with the retaining part 153'. The annular ring 150' cooperates with the retaining part 153' and the head portion 14' of the roller support 10' to define the retaining groove 1531' of the coupling unit thereamong. Through engagement between the tongue 314 and the retaining groove 1531' of the coupling unit, and through the annular ring 150', the tubular sleeve 31 of the roller unit 30 is similarly restricted to rotate around the axis (L) (see FIG. 3).

Figure 7:
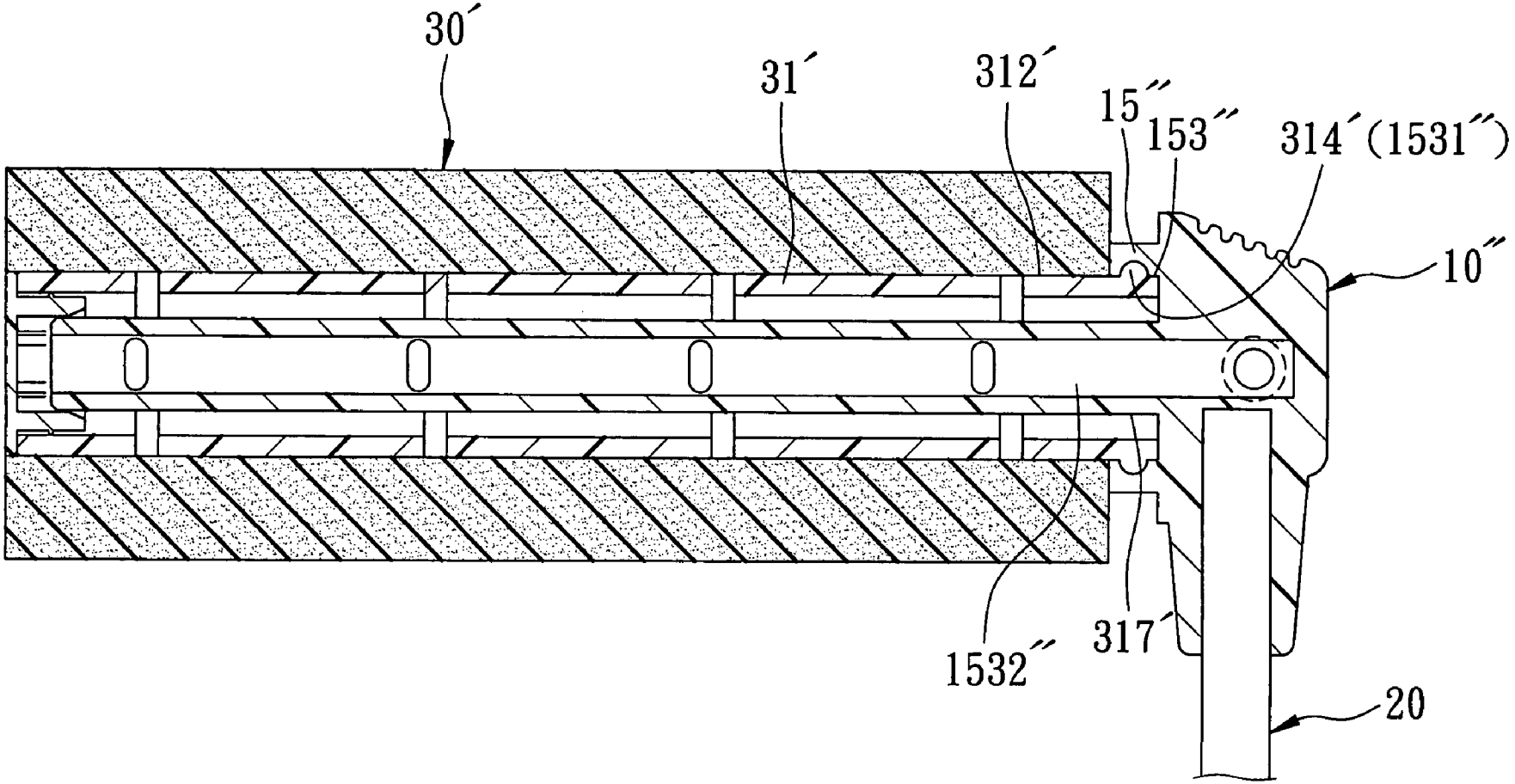
FIG. 7 is a fragmentary assembled sectional view of the third preferred embodiment of a paint roller assembly according to the present invention.

Referring to FIG. 7, the third preferred embodiment of a paint roller assembly according to the present invention is shown to be similar to the first preferred embodiment. Particularly, the paint roller assembly of the present invention comprises a roller support 10", a handle 20 fixed to the roller support 10", and a roller unit 30' mounted rotatably on the roller support 10". However, in this embodiment, the retaining part 153" of the neck portion 15" is formed with an axially extending recess 1532". The first end portion 317' of the tubular sleeve 31' extends into the recess 1532". The retaining groove 1531" of the coupling unit is formed in the retaining part 153" of the neck portion 15", and opens toward the tongue 314'. The tongue 314' of the coupling unit is formed on the first end portion 317' of the tubular sleeve 31', and is configured as an annular protrusion projecting outwardly and radially from the outer peripheral face 312' of the tubular sleeve 31' at the first end portion 317'. Through engagement between the tongue 314' and the retaining groove 1531" of the coupling unit, the roller unit 30' is similarly limited to rotate around the axis (L) (see FIG. 3).

Figure 8:
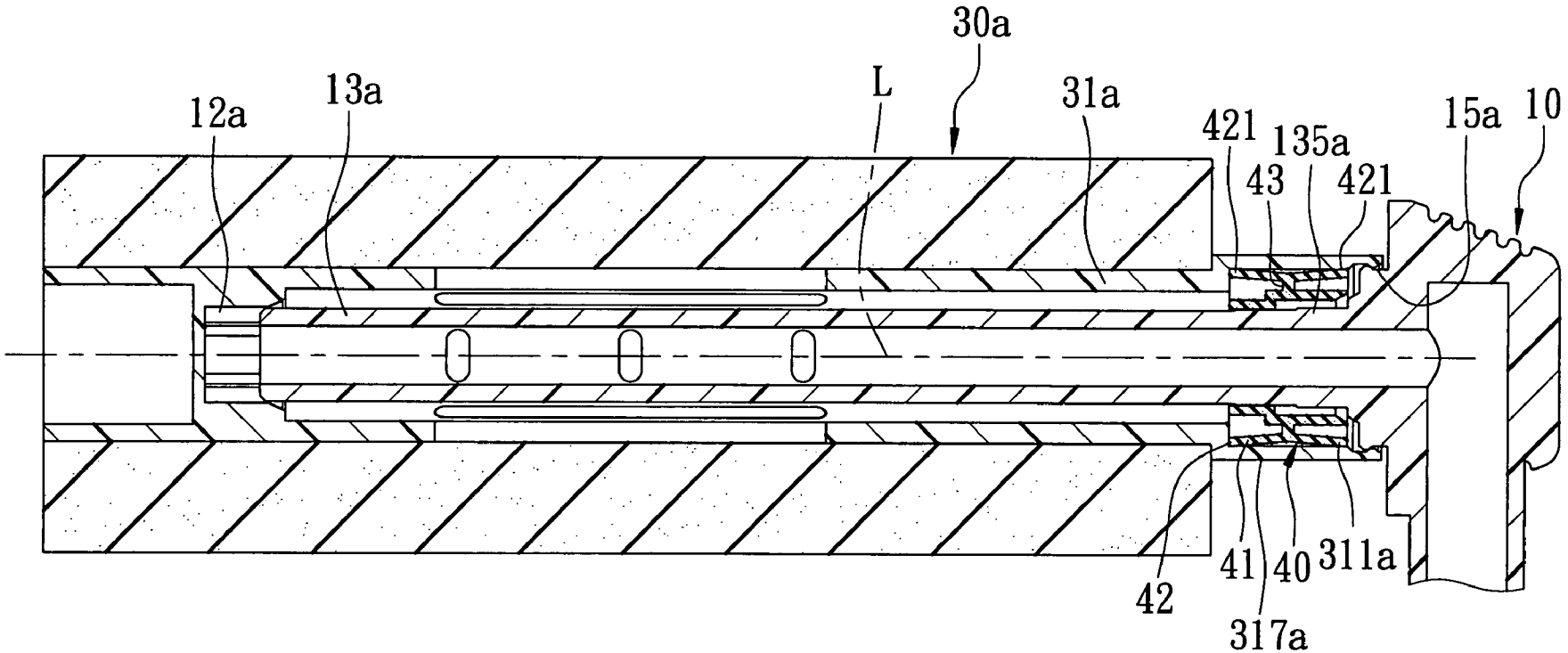
FIG. 8 is a fragmentary sectional view of the fourth preferred embodiment of a paint roller assembly according to the present invention.

Referring to FIG. 8, the fourth preferred embodiment of a paint roller assembly according to the present invention is shown to be similar to the first preferred embodiment. However, in this embodiment, the paint roller assembly further comprises an elastic annular sealing member 40 disposed between the roller support (10*a*) and the roller unit (30*a*). The support tube (13*a*) of the roller support (10*a*) further has a connecting end (135*a*) connected to the neck-portion (15*a*) The end cap (12*a*) is formed integrally with the tubular sleeve (31*a*). The elastic annular sealing member 40 has an inner peripheral wall 41 in sealing contact with the connecting end (135*a*) of the support tube (13*a*), an outer peripheral wall 42 that surrounds the inner peripheral wall 41 and that is in sealing contact with the inner peripheral face (311*a*) of the tubular sleeve (31*a*) at the first end portion (317*a*), and a connecting rib 43 interconnecting the inner and outer peripheral walls 41, 42. The outer peripheral wall 42 of the elastic sealing member 40 has two opposite peripheral ends 421 that gradually converge toward the center thereof so that the diameter of each peripheral end 421 is larger than that at the center of the outer peripheral wall 42. Such a configuration results in reduced contact between the elastic annular sealing member 40 and the inner peripheral face (311*a*) of the tubular sleeve (31*a*), so that when the tubular sleeve (31*a*) rotates relative to the support tube (13*a*), frictional contact between the elastic sealing member 40 and the inner peripheral face (311*a*) of the tubular sleeve (31*a*) can be minimized.

With the inclusion of the coupling unit in the paint roller assembly of this invention, the aforesaid drawbacks associated with the prior art can be eliminated.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A paint roller assembly comprising:

a roller support including a head portion, a neck portion reduced in cross section from said head portion, and a support tube reduced in cross section from said neck portion and defining an axis, said roller support defining an axial hole extending through said support tube and said neck portion and into said head portion along said axis, said support tube having a peripheral wall, a plurality of spaced-apart apertures formed in said peripheral wall and in fluid communication with said axial hole, and a free end distal to said neck portion, said neck portion having a retaining part;

an end cap sleeved on said free end of said support tube;

a coupling unit;

a roller unit including a tubular sleeve that has a first end portion coupled rotatably to said retaining part of said neck portion through said coupling unit, and a second end portion opposite to said first end portion and coupled to said end cap so as to be rotatable relative to said support tube, said roller unit further including a sponge body fixed around said tubular sleeve; and a handle connected to said head portion of said roller support;

wherein said coupling unit is disposed between said retaining part and said first end portion of said tubular sleeve, and includes a tongue provided on one of said retaining part and said first end portion of said tubular sleeve, and a retaining groove formed in the other of said retaining part and said first end portion of said tubular sleeve.

2. The paint roller assembly of claim 1, wherein said end cap includes a flanged portion, a sleeve portion extending axially from said flanged portion and sleeved on said free end of said support tube, and an annular rib projecting radially and outwardly from said sleeve portion and in rotational contact with said tubular sleeve.

3. The paint roller assembly of claim 2, wherein said neck portion further has an annular protrusion protruding radially and outwardly from said retaining part of said neck portion, and cooperating with said retaining part and said head portion to define said retaining groove of said coupling unit thereamong, said tongue of said coupling unit being formed on said first end portion of said tubular sleeve and being configured as an annular protrusion projecting from said first end portion of said tubular sleeve into said retaining groove.

4. The paint roller assembly of claim 2, wherein said coupling unit further has an annular recess formed in said retaining part, and an annular ring disposed in and protruding outwardly from said annular recess and in rotational contact with said retaining part, said annular ring cooperating with said retaining part and said head portion to define said retaining groove of said coupling unit thereamong, said tongue of said coupling unit being formed on said first end portion of said tubular sleeve and being configured as an annular protrusion projecting from said first end portion of said tubular sleeve into said retaining groove.

5. The paint roller assembly of claim 2, wherein said retaining part is formed with an axially extending recess, said first end portion of said tubular sleeve extending into said recess, said tongue of said coupling unit being formed on said first end portion of said tubular sleeve and being configured as an annular protrusion projecting outwardly and radially from said first end portion of said tubular sleeve, said retaining groove of said coupling unit being formed in said retaining part of said neck portion and opening toward said tongue.

6. The paint roller assembly of claim 1, wherein said head portion includes a tubular connecting part in fluid communication with said axial hole and adapted to be connected to a paint supply device.

7. The paint roller assembly of claim 6, wherein said head portion further includes a handle-connecting part for connection with said handle.

8. The paint roller assembly of claim 1, wherein said support tube, said head portion, and said neck portion are formed integrally as one piece.

9. The paint roller assembly of claim 1, wherein said support tube further has a connecting end connected to said neck portion, said paint roller assembly further comprising an elastic annular sealing member disposed between and in sealing contact with said connecting end of said support tube and said first end portion of said tubular sleeve.

10. The paint roller assembly of claim 9, wherein said end cap is formed integrally with said tubular sleeve.

* * * * *